US008348179B2

(12) United States Patent
Wang et al.

(10) Patent No.: US 8,348,179 B2
(45) Date of Patent: Jan. 8, 2013

(54) GEAR TYPED SPRINKLER ASSEMBLY

(75) Inventors: Po-Hsiung Wang, Miao-Li Hsien (TW); Tzu-Meng Wang, Miao-Li Hsien (TW)

(73) Assignee: Kwan-Ten Enterprise Co., Ltd., Miao-Li Hsien (TW)

( * ) Notice: Subject to any disclaimer, the term of this patent is extended or adjusted under 35 U.S.C. 154(b) by 173 days.

(21) Appl. No.: 13/018,434

(22) Filed: Feb. 1, 2011

(65) Prior Publication Data

US 2012/0097760 A1 Apr. 26, 2012

(30) Foreign Application Priority Data

Oct. 22, 2010 (TW) ..... 99220462 U

(51) Int. Cl.
*B05B 3/04* (2006.01)
*B05B 3/02* (2006.01)
*B05B 3/00* (2006.01)

(52) U.S. Cl. ..... 239/240; 239/246; 239/248; 239/263.3

(58) Field of Classification Search ..... 239/200–206, 239/225.1, 237, 240, 242, 246, 248, 263.3, 239/273, 275, DIG. 1
See application file for complete search history.

(56) References Cited

U.S. PATENT DOCUMENTS 2,253,979 A 8/1941 De Lacy-Muhall
3,934,820 A 1/1976 Phaup
4,417,691 A 11/1983 Lockwood
4,784,325 A 11/1988 Walker et al.
4,787,558 A 11/1988 Sexton et al.
4,925,098 A 5/1990 Di Paola
5,174,501 A 12/1992 Hadar
5,330,103 A 7/1994 Eckstein
D351,214 S 10/1994 Clivio
5,611,488 A 3/1997 Frolich
5,772,117 A 6/1998 Su
6,540,163 B1 4/2003 Huang
6,732,950 B2 5/2004 Ingham, Jr. et al.
6,814,304 B2 11/2004 Onofrio
6,883,727 B2 4/2005 De Los Santos
6,929,194 B2 8/2005 Lawson
7,168,634 B2 1/2007 Onofrio
7,191,958 B1 3/2007 Wang
7,422,162 B2 9/2008 Wang et al.
(Continued)

OTHER PUBLICATIONS

Wang et al, "Sprinkler Device", U.S. Appl. No. 12/807,954.

(Continued)

*Primary Examiner* — Darren W Gorman
(74) *Attorney, Agent, or Firm* — Pai Patent & Trademark Law Firm; Chao-Chang David Pai

(57) ABSTRACT

A sprinkler assembly has a body, a base assembly, a wheel, a gear assembly, a discharging valve, a spraying head and a cover. The wheel is rotatably mounted in a wheel chamber in the base assembly and has a driving gear. The gear assembly has gear sets engaging each other. Each gear set has a driving gear and a driven gear coaxially mounted on the driving gear. The driving gear has a number of teeth different from that of the driving gear. The driving gear of one of the gear set engages the driving gear on the wheel. The discharging valve has at least one discharging hole. The spraying head is coaxially connected rotatably to the discharging valve and has at least one aligning hole selectively aligns respectively with the at least one discharging hole in the discharging valve.

15 Claims, 8 Drawing Sheets

U.S. PATENT DOCUMENTS

| | | | | |
|---|---|---|---|---|
| 7,427,038 | B2 | 9/2008 | Wang et al. | |
| 2007/0119977 | A1* | 5/2007 | Wang et al. | 239/240 |
| 2007/0119978 | A1* | 5/2007 | Wang et al. | 239/242 |
| 2008/0197211 | A1* | 8/2008 | Hsieh | 239/242 |
| 2011/0079662 | A1 | 4/2011 | Wang et al. | |

OTHER PUBLICATIONS

Wang et al, "Sprinkler Adapter Device Having Multiple Rates of Output Flow", U.S. Appl. No. 12/930,092.

* cited by examiner

GEAR TYPED SPRINKLER ASSEMBLY

BACKGROUND OF THE INVENTION

1. Field of the Invention

The present invention relates to a sprinkler assembly, and more particularly to a gear typed sprinkler assembly that can spray water discontinuously.

2. Description of Related Art

Sprinklers are important parts for gardening and not only can spray water for watering plants but also can spray water in different patterns for providing vision aesthetic effect.

The sprinkler is connected to a pressured water source and sprays water out from spraying holes defined in the sprinkler with the interior structures in the sprinkler. The sprinkler may be rotatable to fit with different user needs. However, to rotate the conventional rotatable sprinkler, a water source with a large pressure is necessary. In addition, after a term of use, the sprinkler may be jammed by small or tiny articles or objects entering in the sprinkler, and this will cause unsmooth rotation or even complete non-rotation of the sprinkler.

To overcome the shortcomings, the present invention tends to provide a sprinkler assembly to mitigate or obviate the aforementioned problems.

SUMMARY OF THE INVENTION

The main objective of the invention is to provide a sprinkler assembly that can spray water discontinuously and can be driven with an enlarged torque by a gear assembly.

The sprinkler assembly has a body, a base assembly, a wheel, a gear assembly, a discharging valve, a spraying head and a cover. The body has a holding chamber defined in the body and a connecting plug formed on one end of the body and having an inlet. The base assembly is mounted in the holding chamber of the body and has a lower base and an upper base. The lower base has a wheel chamber formed in the bottom and a water entrance formed in the bottom and communicating with the wheel chamber via a passage. The upper base is hollow, is formed on and protrudes from the top of the lower base and has a bottom segment separated from the top of the lower base to define a gap between the bottom segment of the upper base and the top of the lower base and communicating with the wheel chamber in the lower base. The wheel is rotatably mounted in the wheel chamber in the lower base and has a driving gear and multiple blades. The driving gear is mounted through the top of the top of the lower base and is held in the gap between the lower and upper bases. The blades are formed around the driving gear, and each blade has a free end corresponding to the passage. The gear assembly has gear sets engaging each other. Each gear set has a driving gear and a driven gear coaxially mounted on the driving gear. The driving gear has a number of teeth different from that of the driving gear. The driving gear of one of the gear set engages the driving gear on the wheel. The discharging valve is mounted on the base assembly and has a valve board mounted on the base assembly and at least one discharging hole defined through the valve board. The spraying head is hollow, is coaxially connected rotatably to the discharging valve and has multiple spraying holes, a driven gear and at least one aligning hole. The spraying holes are defined in the spraying head at positions away from the bottom of the spraying head. The driven gear is mounted around the bottom of the spraying head and engages the driven gear of one of the gear sets of the gear assembly. The at least one aligning hole is defined through the bottom of the spraying head and selectively aligns respectively with the at least one discharging hole in the discharging valve. The cover is mounted on the body and has a through hole defined through the cover and through which the spraying head extends out.

With such an arrangement, a large torque can be provided with the transmission of the gears of the gear assembly to drive the spray head easily to rotate relative to the discharging valve. With the alignment or misalignment of the aligning holes in the spraying head 60 with the discharging holes in the discharging vale, a non-continuous spraying water flow is achieved.

Other objects, advantages and novel features of the invention will become more apparent from the following detailed description when taken in conjunction with the accompanying drawings.

DETAILED DESCRIPTION OF PREFERRED EMBODIMENT

Figure 1:
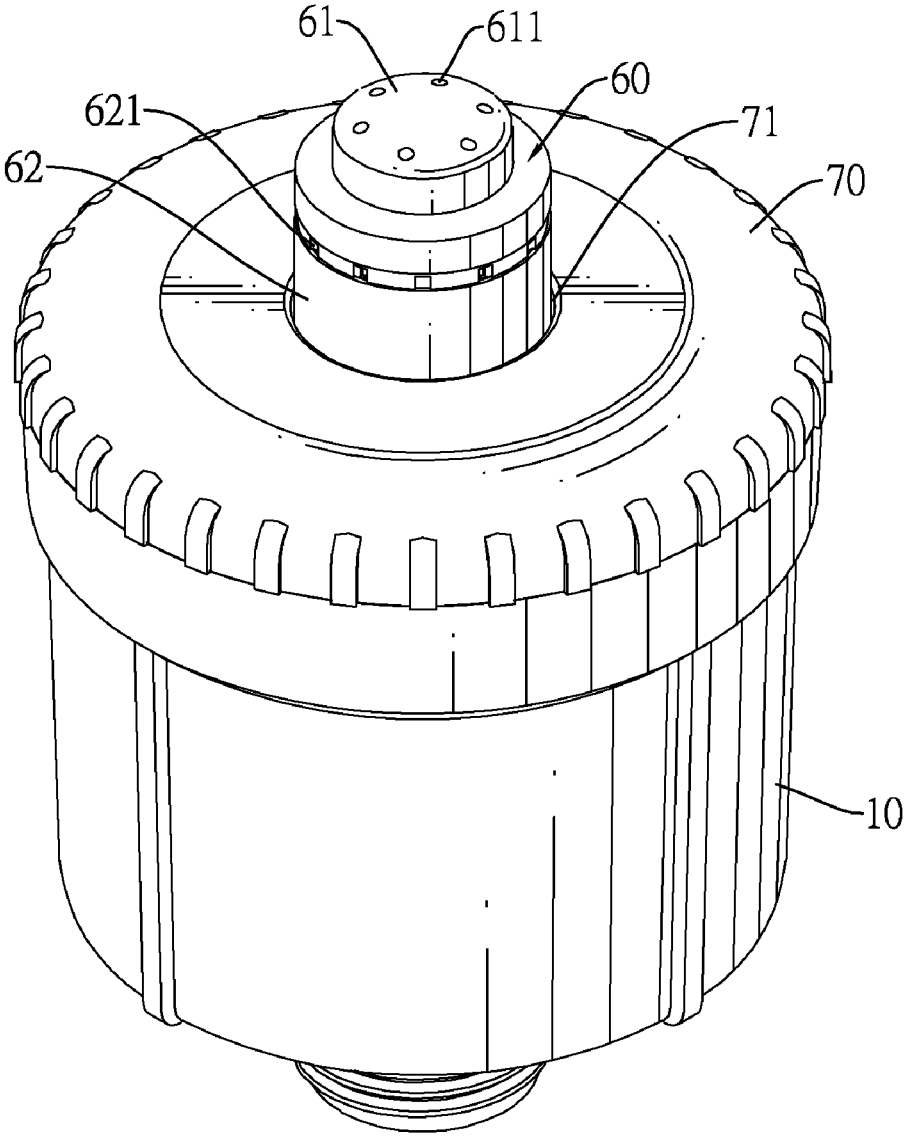
FIG. 1 is a perspective view of a sprinkler assembly in accordance with the present invention.
Figure 2:
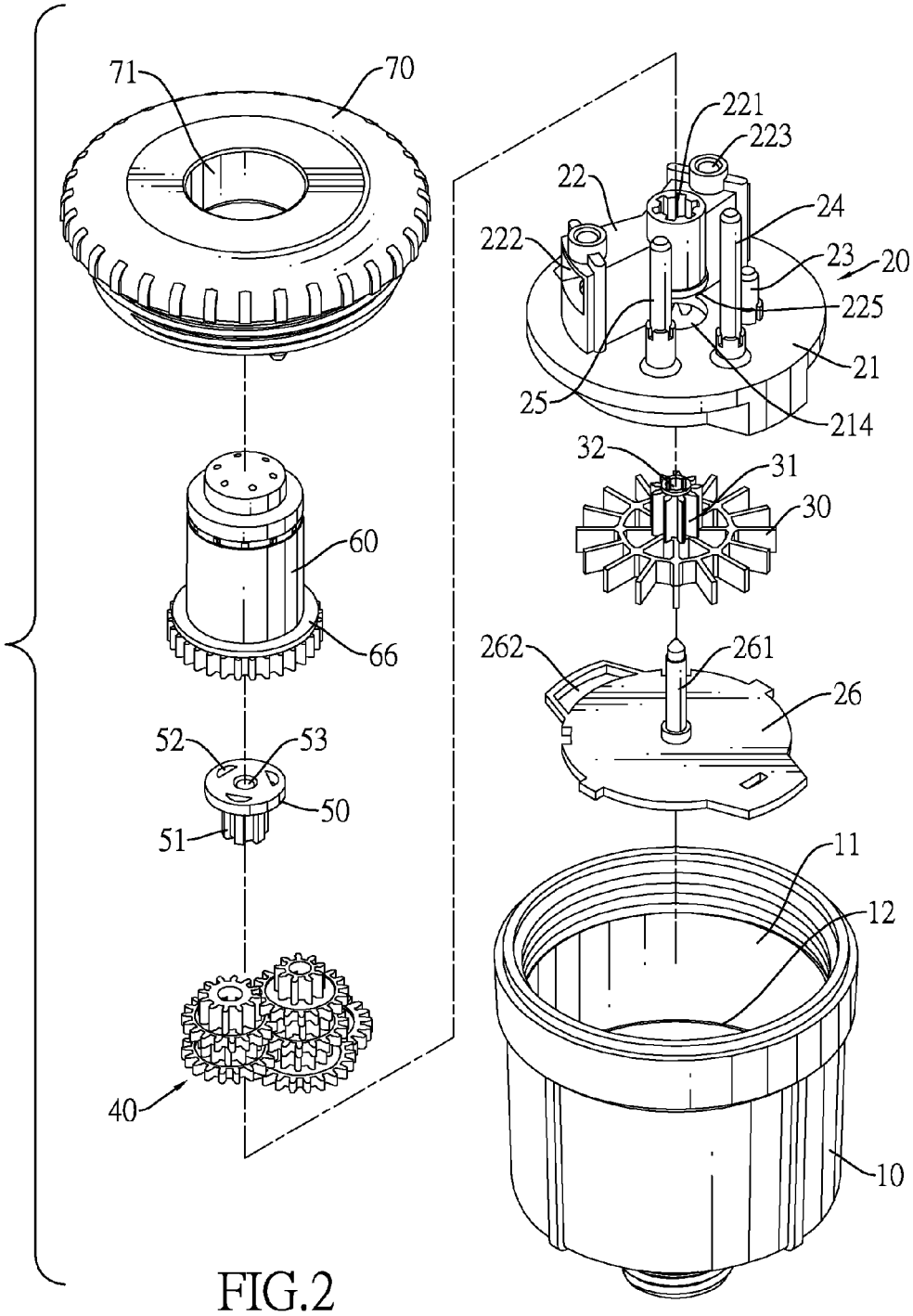
FIG. 2 is an exploded perspective view of the sprinkler assembly in FIG. 1.
Figure 3:
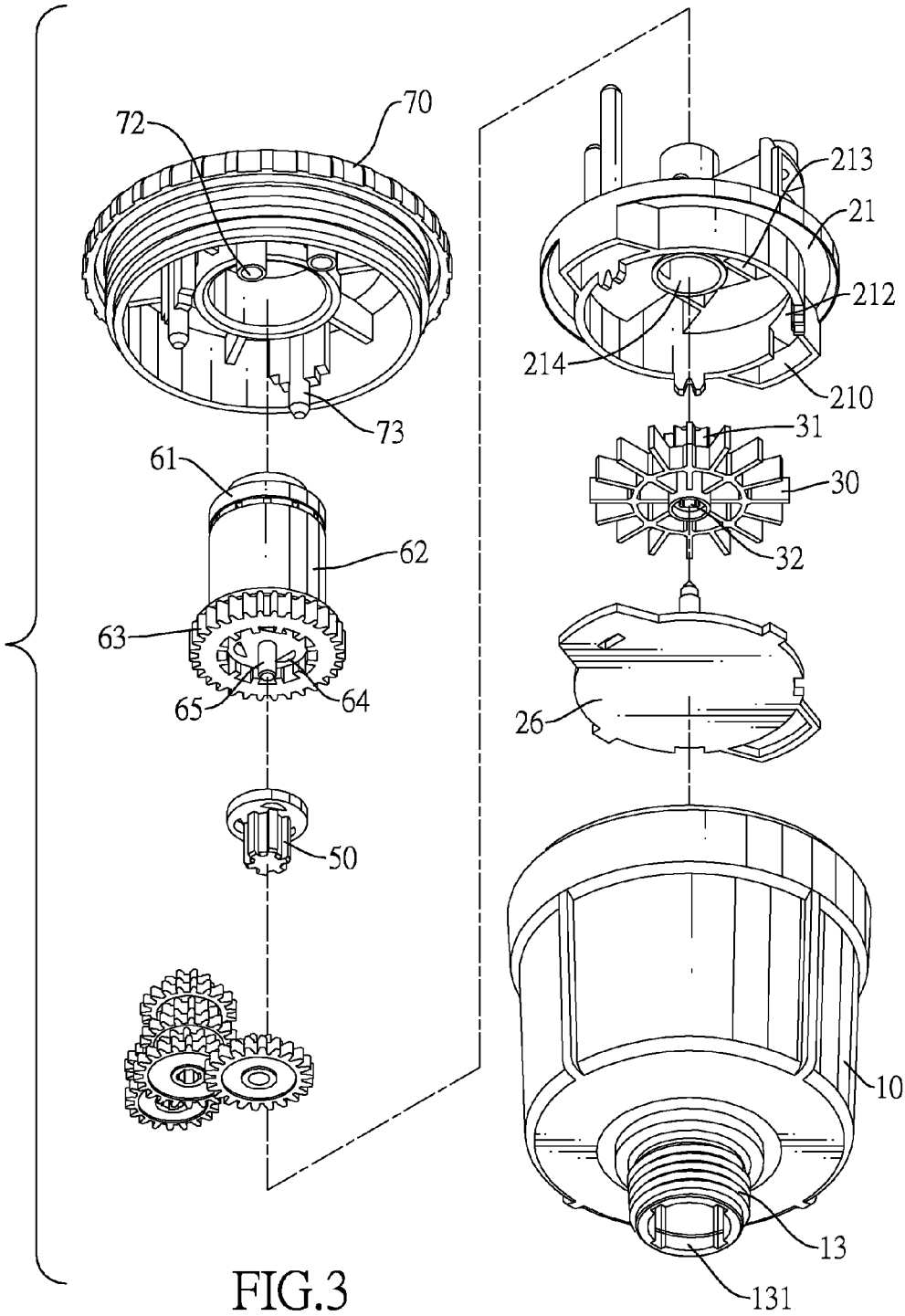
FIG. 3 is another exploded perspective view of the sprinkler assembly in FIG. 1.

With reference to FIGS. 1 to 3, a gear typed sprinkler assembly in accordance with the present invention comprises a body 10, a base assembly 20, a wheel 30, a gear assembly 40, a discharging valve 50, a spraying head 60 and a cover 70.

The body 10 has a holding chamber 11, a top opening, an inner thread and a connecting plug 13. The holding chamber 11 is defined in the body 10. The top opening is defined in the top of the body 10 and communicates with the holding chamber 11. The inner thread is formed in the inner surface of the top opening of the body 10. The connecting plug 13 is tubular, is formed on one end of the body 10 and has an inlet 131 defined through the connecting plug 13. With the connecting plug 13, the body 10 is connected to a water source to enable pressured water to enter into the holding chamber 11 of the body 10 via the inlet 131.

The base assembly 20 is mounted in the holding chamber 11 of the body 10 and comprises a lower base 21, an upper base 22 and a bottom lid 26.

Figure 4:
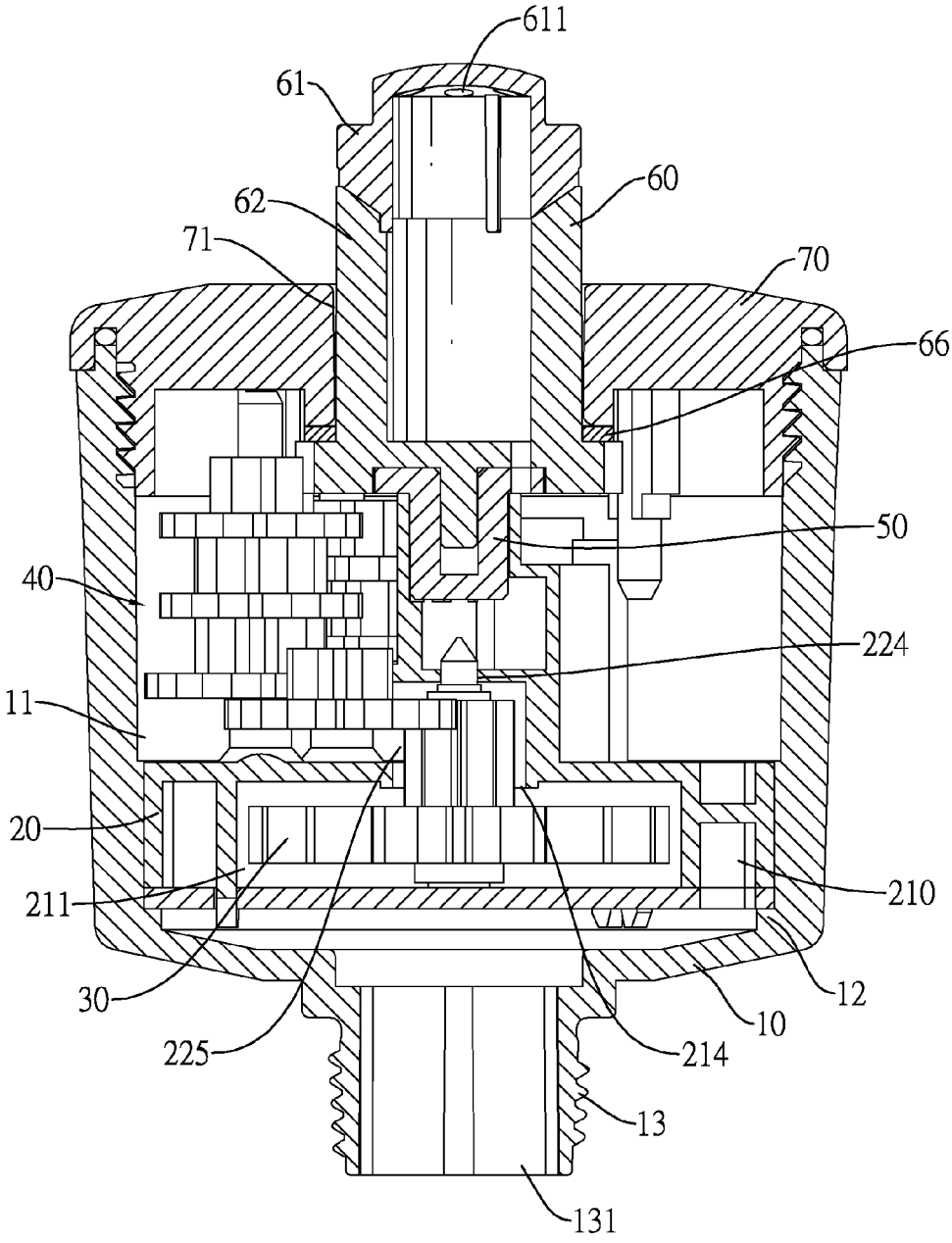
FIG. 4 is an enlarged side view in partial section of the sprinkler assembly in FIG. 1.
Figure 5:
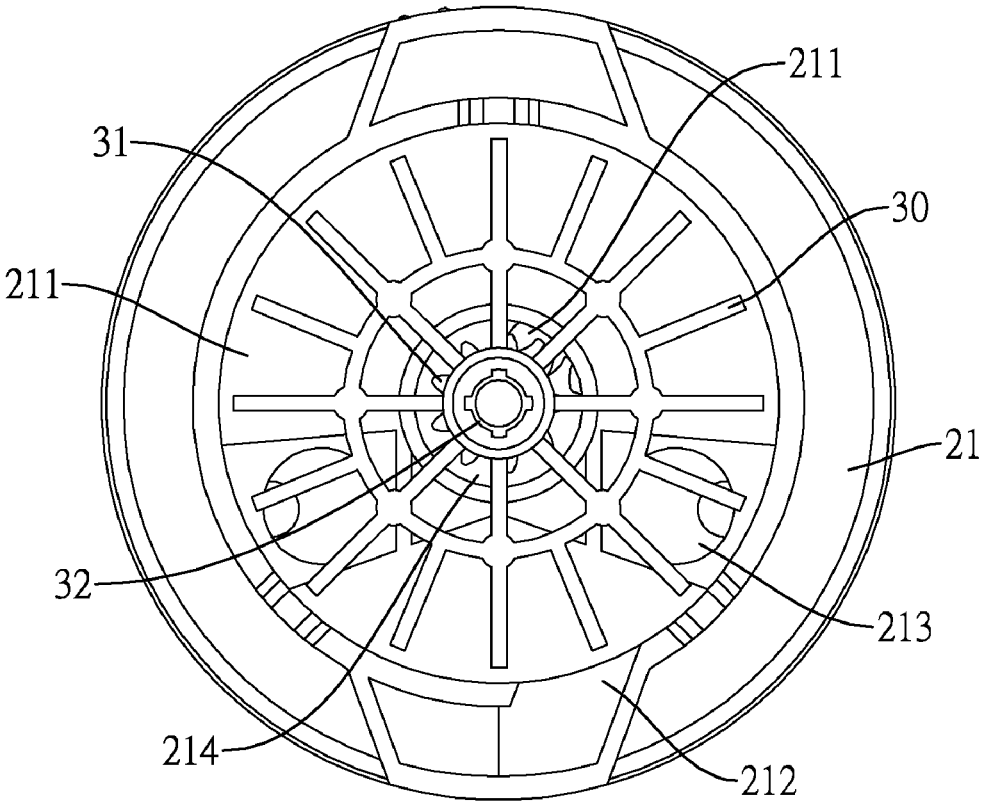
FIG. 5 is an enlarged bottom view of the base assembly and the wheel of the sprinkler assembly in FIG. 1.

With further reference to FIGS. 4 and 5, the lower base 21 has a wheel chamber 211, a water entrance 210, multiple gear axles, a central hole 214 and multiple water orifices 213. The wheel chamber 211 is formed in the bottom of the lower base 21 and may be circular in cross section. The water entrance 210 is formed in the bottom near the periphery of the lower base 21 and communicates with the wheel chamber 211 via a passage 212. Accordingly, the water can enter the wheel chamber 211 via the water entrance 210 and the passage 212 from a position away from the center of the wheel chamber 211 of the lower base 21. The gear axles are formed on and protrude from the top of the lower base 21 and are separated from each other. Preferably, three gear axles are implemented and include a first gear axle 23, a second gear axle 24 and a third gear axle 25. The central hole 214 is defined through the lower base 21 and communicates with the wheel chamber 211. The water orifices 213 are defined through the lower base 21 and communicate with the wheel chamber 211.

The upper base 22 is hollow, is formed on and protrudes from the top of the lower base 21, communicates with the water orifices 213 in the lower base 21 and has a bottom segment, an axle hole 224, a post hole 221, multiple column holes 223 and multiple side openings 222. The bottom segment is separated from the top of the lower base 21 to define a gap 225 between the bottom segment of the upper base 22 and the top of the lower base 21 and communicates with the central hole 214 and the wheel chamber 211 in the lower base 21. The axle hole 224 is defined in the bottom segment of the upper base 22 and communicates with the gap 225 to make the gap 225 communicating with the upper base 22. The post hole 221 is defined in the top of the upper base 21 and may have a non-circular cross section. The column holes 223 are defined in the top of the upper base 22. The multiple side openings 222 are defined in the upper base 22 and communicate with the holding chamber 11 in the body 10.

The bottom lid 26 is attached to the bottom of the lower base 21 by hooks and holes to close the wheel chamber 211 and the water entrance 210 and has a wheel axle 261 and a water opening 262. The wheel axle 261 is formed on and protrudes from the bottom lid 26 and has a top extending into the axle hole 224 in the bottom segment of the upper base 22 via the central hole 214 in the lower base 21 and the gap 225 between the bases 21,22. The water opening 262 is defined through the bottom lid 26 and aligns and communicates with the water entrance 210 in the lower base 21.

The wheel 30 is rotatably mounted in the wheel chamber 211 in the lower base 21, is mounted rotatably around the wheel axle 261 on the bottom lid 26 and has a driving gear 31 and multiple blades. The driving gear 31 is mounted through the top of the top of the lower base 21 via the central hole 214 and is held in the gap 225 between the lower and upper bases 21,22. The driving gear 31 has an axle hole 32 defined through the driving gear 31 and around which the wheel axle 261 is mounted to mount the wheel 30 rotatably around the wheel axle 261. The blades are formed around the driving gear 31, and each blade has a free end corresponding to the passage 212. Accordingly, the water entering into the wheel chamber 211 via the water entrance 210 and the passage 212 can push against the blades to rotate the wheel 30.

Figure 6:
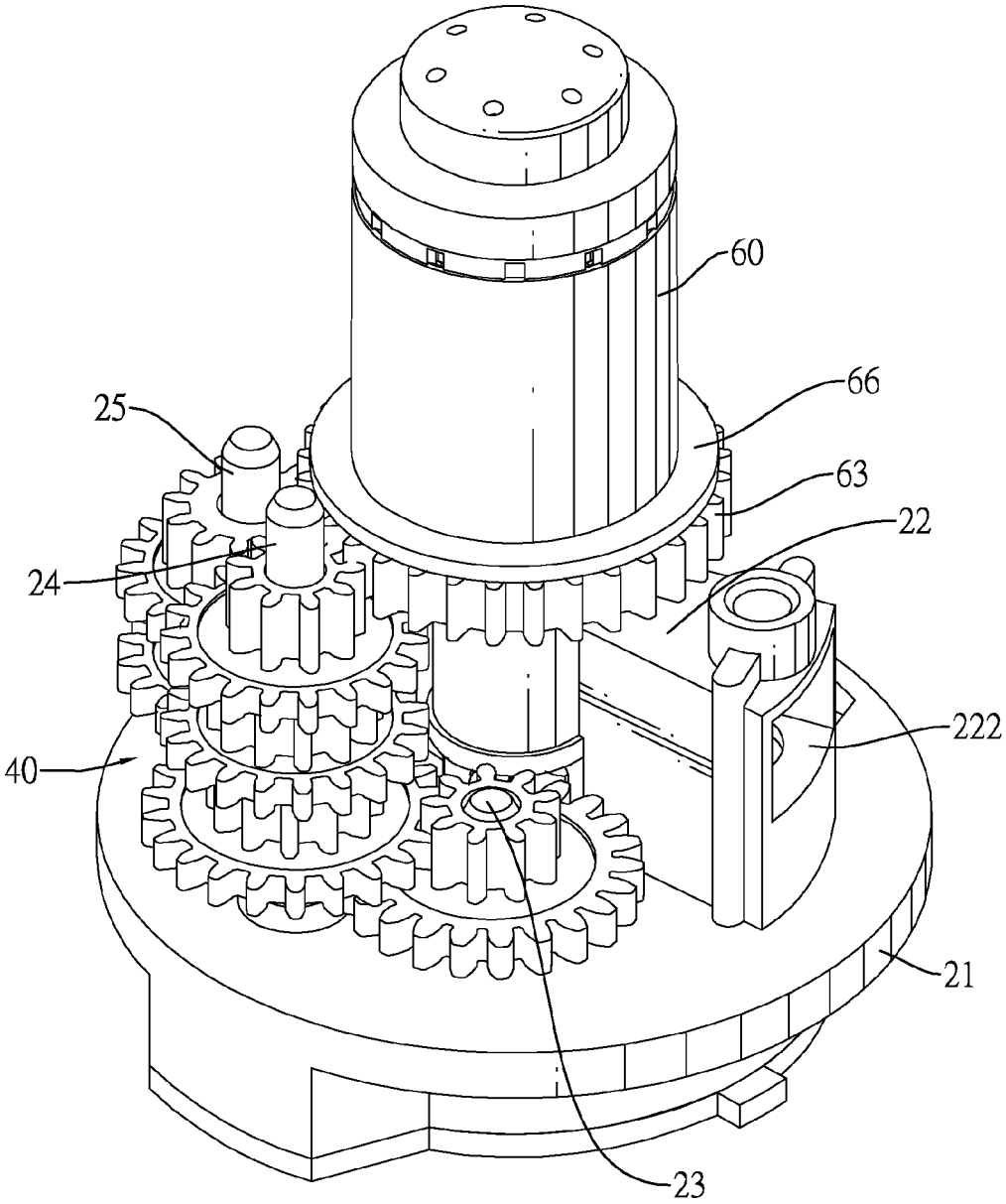
FIG. 6 is an enlarged perspective view of the base assembly, the gear assembly and the spraying head of the sprinkler assembly in FIG. 1.
Figure 7:
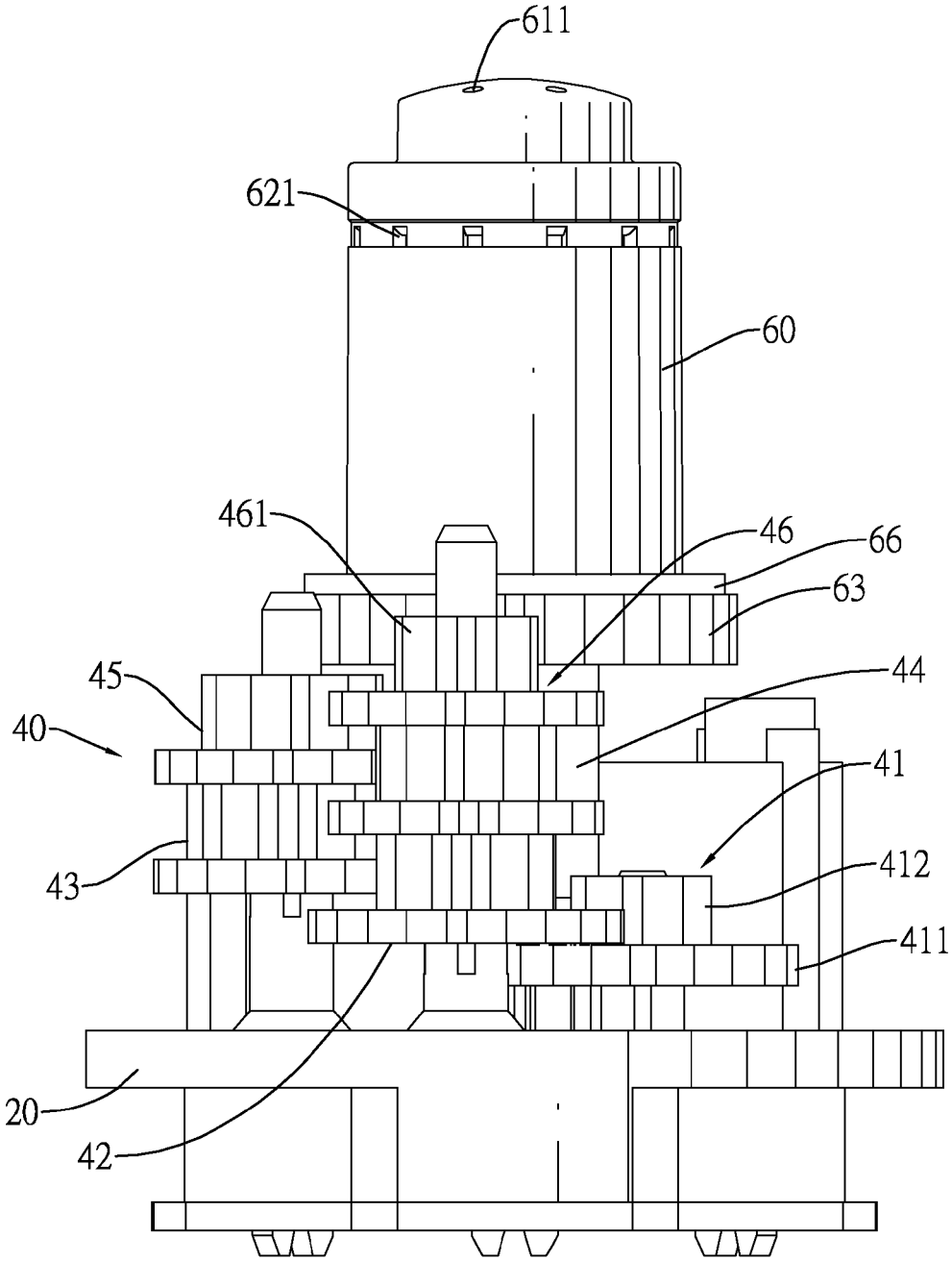
FIG. 7 is a side view of the base assembly, the gear assembly and the spraying head of the sprinkler assembly in FIG. 6.

With further reference to FIGS. 6 and 7, the gear assembly 40 is mounted on the base assembly 20 and comprises multiple gear sets engaging each other. Each gear set comprises a driving gear and a driven gear coaxially mounted on the driving gear. The driven gear has a number of teeth different from that of the driving gear. Preferably, six gear sets are implemented and includes a first gear set 41, a second gear set 42, a third gear set 43, a fourth gear set 44, a fifth gear set 45 and a sixth gear set 46. The first gear set 41 is mounted around the first gear axle 23 on the lower base 21, and the driving gear 411 of the first gear set 41 engages the driving gear 31 on the wheel 30. The second gear set 42 is mounted around the second gear axle 24 on the lower base 21, and the driving gear of the second gear set 42 engages the driven gear 412 of the first gear set 41. The third gear set 43 is mounted around the third gear axle 25 on the lower base 21, and the driving gear of the third gear set 43 engages the driven gear of the second gear set 42. The fourth gear set 44 is mounted around the second gear axle 24 on the lower base 21, and the driving gear of the fourth gear set 44 engages the driven gear of the third gear set 43. The fifth gear set 45 is mounted around the third gear axle 25 on the lower base 21, and the driving gear of the fifth gear set 45 engages the driven gear of the fourth gear set 44. The sixth gear set 46 is mounted around the second gear axle 24 on the lower base 21, and the driving gear of the sixth gear set 46 engages the driven gear of the fifth gear set 45. Accordingly, the gears of the gear assembly 40 can be rotated while the wheel 30 is rotated.

The discharging valve 50 is mounted on the base assembly 20 and has a valve board, at least one discharging hole 52, a positioning post 51 and a spindle hole 53. The valve board is mounted on the upper base 22 of the base assembly 20. The at least one discharging hole 52 is defined through the valve board. The positioning post 51 is formed on and protrudes from the bottom of the valve board, is mounted securely in the post hole 221 in the upper base 22 and may have a non-circular cross section. The spindle hole 53 is defined in the center of the top of the valve board.

The spraying head 60 is hollow, is coaxially connected rotatably to the discharging valve 50 and has multiple spraying holes 611,621, a driven gear 63, at least one aligning hole 64, a spindle 65 and a gasket 66. The spraying holes 611,621 are defined in the spraying head 60 at positions away from the bottom of the spraying head 60. The driven gear 63 is mounted around the bottom of the spraying head 60 and engages the driven gear 461 of the sixth gear set 46 of the gear assembly 40. The at least one aligning hole 64 is defined through the bottom of the spraying head 60 and selectively aligns respectively with the at least one discharging hole 52 in the discharging valve 50. The spindle 65 is formed on and protrudes from the bottom of the spraying head 60 and is mounted rotatably in the spindle hole 53 in the valve board of the discharging valve 50. Preferably, the spraying head 60 is implemented as by an upper head 61 and a lower head 62 combined with each other. The upper head 61 is hollow and has multiple first spraying holes 611, a conical bottom and multiple inclined slots. The first spraying holes 611 are defined through the top of the upper head 61. The inclined slots are formed radially in the conical bottom. The lower head 62 is connected to the conical bottom of the upper head 61 and has a conical recess. The conical recess is defined in the top of the lower head 62 and holds the conical bottom of the upper head 61 inside to define multiple second spraying holes 621 by the conical recess in cooperation with the inclined slots in the conical bottom of the upper head 61. The gasket 66 is mounted around the spraying head 60 above the driven gear 63 and may be made of Teflon™.

The cover 70 is mounted on the body 10, abuts with the gasket 66 on the spraying head 60 and has a through hole 71, multiple connecting tubes 72, multiple connecting columns 73 and an outer thread. With the abutment between the cover 70 and the gasket 66, an excellent sealing effect and a wearing-resisting effect are provided while the spraying head 60 being driven to rotate. The through hole 71 is defined centrally through the cover 70, and the spraying head 60 extends out of the through hole 71 of the cover 70. The connecting tubes 72 are formed on the bottom of the cover 70 and are connected respectively with the gear axles 23,24,25 on the lower base 21. The connecting columns 73 are formed on and protrude from the bottom of the cover 70 and are mounted respectively into the column holes 223 in the upper base 21. The outer thread is formed around the cover 70 and is screwed with the inner thread in the body 10 to mount the cover 70 securely on the body 10.

In use, the pressured water enters into the holding chamber 11 via the inlet 131 in the connecting plug 13 or into the wheel chamber 211 via the water opening 262 in the bottom lid 26, the water entrance 210 and the passage 212. When the pressured water enters into the wheel chamber 211, the wheel 30 and the gears of the gear assembly 40 can be driven to rotate. The water can flow out of the wheel chamber 211 from the water orifices 213 and into the upper base 22 and then is discharged from the side openings 222 in the upper base 22. The water may also flow out of the wheel chamber 211 from the central hole 214 and into the gap 225 and the holding chamber 11 in the body 10. Accordingly, the holding chamber 11 in the body 10 can be filled with water completely.

When the gear assembly 40 is driven to rotate, the spraying head 60 can also be driven to rotate relative to the discharging valve 50. With the engagement between the gears of the gear assembly 40, a large torque can be provided and applied to rotate the spraying head 60 so that the spraying head 60 can be rotated easily. The sprinkle assembly in accordance with the present invention is not easily jammed or blocked by small or tiny objects and is convenient and durable in use.

While the spraying head 60 is rotating, the water can be led into the spraying head 60 and sprayed out from spraying holes 611,621 when the aligning holes 64 in the spraying head 60 align with the discharging holes 52 in the discharging vale 50. When the aligning holes 64 in the spraying head 60 is in misalign with the discharging holes 52 in the discharging vale 50, the aligning holes 64 can be closed and the water is kept from entering into the spraying head 60, such that a non-continuous spraying water flow is achieved.

Figure 8:
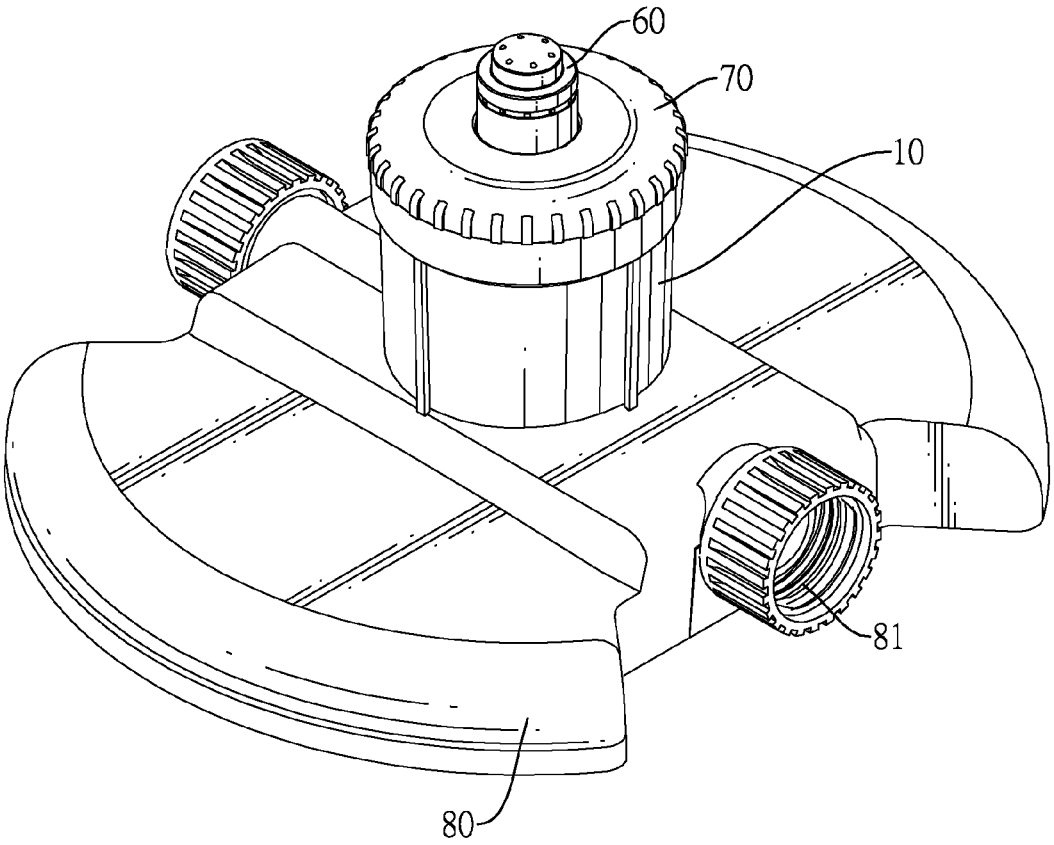
FIG. 8 is a perspective view of the sprinkler assembly device in FIG. 1 mounted on a seat.

With reference to FIG. 8, the sprinkler assembly can be mounted on a seat 80. The seat 80 has a water inlet 81 and a mounting connector. The water inlet 81 is formed on one end of the seat 80 to connect to a water source. The mounting connector is formed on the top of the seat 80 for connecting with the connecting plug 13 on the body 10. Hence, water flowing from the water source can enter the body 10 through the water inlet 81 and be sprayed out from the spraying holes 611,621 in the spraying head 60.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sprinkler assembly comprising:

a body having a holding chamber defined in the body; and a connecting plug formed on one end of the body and having an inlet;

a base assembly mounted in the holding chamber of the body and comprising a lower base having a top;

a bottom;

a wheel chamber formed in the bottom; and a water entrance formed in the bottom and communicating with the wheel chamber via a passage; and an upper base being hollow, formed on and protruding from the top of the lower base and having a bottom segment separated from the top of the lower base to define a gap between the bottom segment of the upper base and the top of the lower base and communicating with the wheel chamber in the lower base;

a wheel rotatably mounted in the wheel chamber in the lower base and having a driving gear mounted through the top of the top of the lower base and held in the gap between the lower and upper bases; and multiple blades formed around the driving gear and each blade having a free end corresponding to the passage;

a gear assembly comprising multiple gear sets engaging each other, each gear set comprising a driving gear and a driven gear coaxially mounted on the driving gear and having a number of teeth different from that of the driving gear, wherein the driving gear of one of the gear set engages the driving gear on the wheel;

a discharging valve mounted on the base assembly and having a valve board mounted on the base assembly; and at least one discharging hole defined through the valve board;

a spraying head being hollow, coaxially connected rotatably to the discharging valve and having a bottom;

multiple spraying holes defined in the spraying head at positions away from the bottom of the spraying head;

a driven gear mounted around the bottom of the spraying head and engaging the driven gear of one of the gear sets of the gear assembly; and at least one aligning hole defined through the bottom of the spraying head and selectively aligning respectively with the at least one discharging hole in the discharging valve; and a cover mounted on the body and having a through hole defined through the cover and through which the spraying head extends out.

2. The sprinkler assembly as claimed in claim 1, wherein the lower base further has three gear axles formed on and protruding from the top of the lower base, separated from each other and including a first gear axle, a second gear axle and a third gear axle;

the gear sets are respectively mounted rotatably around the gear axles;

the driving gear on the wheel engages the driving gear on the gear set that is mounted around the first gear axle; and the driven gear on the spraying head engages the driven gear on the gear set that is mounted around the second gear axle.

3. The sprinkler assembly as claimed in claim 2, wherein the base assembly further comprises a bottom lid attached to the bottom of the lower base to close the wheel chamber and the water entrance and having a wheel axle around which the wheel is mounted rotatably formed on and protruding from the bottom lid; and a water opening defined through the bottom lid and aligning and communicating with the water entrance in the lower base; and the upper base further has an axle hole defined in the bottom segment of the upper base and into which a top of the wheel axle is mounted.

4. The sprinkler assembly as claimed in claim 3, wherein the upper base further has a post hole defined in a top of the upper base;

the discharging valve further has a positioning post formed on and protruding from a bottom of the valve board and mounted securely in the post hole in the upper base; and a spindle hole defined in a top of the valve board; and the spraying head further has a spindle formed on and protruding from the bottom of the spraying head and mounted rotatably in the spindle hole in the valve board of the discharging valve.

5. The sprinkler assembly as claimed in claim 4, wherein the gear assembly comprises six gear sets including a first gear set mounted around the first gear axle on the lower base and engaging the driving gear on the wheel;

a second gear set mounted around the second gear axle on the lower base and engaging the first gear set;

a third gear set mounted around the third gear axle on the lower base and engaging the second gear set;

a fourth gear set mounted around the second gear axle on the lower base and engaging the third gear set;

a fifth gear set mounted around the third gear axle on the lower base and engaging the fourth gear set; and a sixth gear set mounted around the second gear axle on the lower base and engaging the fifth gear set and the driven gear on the spraying head.

6. The sprinkler assembly as claimed in claim 5, wherein the spraying head comprises an upper head being hollow and having multiple first spraying holes defined through a top of the upper head;

a conical bottom; and multiple inclined slots formed in the conical bottom;

a lower head connected to the conical bottom of the upper head and having a conical recess defined in a top of the lower head and holding the conical bottom of the upper head inside to define multiple second spraying holes by the conical recess in cooperation with the inclined slots in the conical bottom of the upper head.

7. The sprinkler assembly as claimed in claim 6, wherein the cover further has multiple connecting tubes formed on a bottom of the cover and connected respectively with the gear axles on the lower base; and multiple connecting columns formed on and protruding from the bottom of the cover; and the upper base further has multiple column holes defined in the top of the upper base and mounted respectively around the connecting columns on the cover.

8. The sprinkler assembly as claimed in claim 7, wherein the lower base further has a central hole defined through the lower base and communicating with the wheel chamber and the gap between the lower and upper bases; and the upper base further has multiple side openings defined in the upper base and communicating with the holding chamber in the body.

9. The sprinkler assembly as claimed in claim 1, wherein the base assembly further comprises a bottom lid attached to the bottom of the lower base to close the wheel chamber and the water entrance and having a wheel axle around which the wheel is mounted rotatably formed on and protruding from the bottom lid; and a water opening defined through the bottom lid and aligning and communicating with the water entrance in the lower base; and the upper base further has an axle hole defined in the bottom segment of the upper base and into which a top of the wheel axle is mounted.

10. The sprinkler assembly as claimed in claim 1, wherein the upper base further has a post hole defined in a top of the upper base;

the discharging valve further has a positioning post formed on and protruding from a bottom of the valve board and mounted securely in the post hole in the upper base; and a spindle hole defined in a top of the valve board; and the spraying head further has a spindle formed on and protruding from the bottom of the spraying head and mounted rotatably in the spindle hole in the valve board of the discharging valve.

11. The sprinkler assembly as claimed in claim 1, wherein the spraying head comprises an upper head being hollow and having multiple first spraying holes defined through a top of the upper head;

a conical bottom; and multiple inclined slots formed in the conical bottom;

a lower head connected to the conical bottom of the upper head and having a conical recess defined in a top of the lower head and holding the conical bottom of the upper head inside to define multiple second spraying holes by the conical recess in cooperation with the inclined slots in the conical bottom of the upper head.

12. The sprinkler assembly as claimed in claim 1, wherein the lower base further has a central hole defined through the lower base and communicating with the wheel chamber and the gap between the lower and upper bases; and the upper base further has multiple side openings defined in the upper base and communicating with the holding chamber in the body.

13. The sprinkler assembly as claimed in claim 2, wherein the gear assembly comprises six gear sets including a first gear set mounted around the first gear axle on the lower base and engaging the driving gear on the wheel;

a second gear set mounted around the second gear axle on the lower base and engaging the first gear set;

a third gear set mounted around the third gear axle on the lower base and engaging the second gear set;

a fourth gear set mounted around the second gear axle on the lower base and engaging the third gear set;

a fifth gear set mounted around the third gear axle on the lower base and engaging the fourth gear set; and a sixth gear set mounted around the second gear axle on the lower base and engaging the fifth gear set and the driven gear on the spraying head.

14. The sprinkler assembly as claimed in claim 13, wherein the cover further has multiple connecting tubes formed on a bottom of the cover and connected respectively with the gear axles on the lower base; and multiple connecting columns formed on and protruding from the bottom of the cover; and the upper base further has multiple column holes defined in the top of the upper base and mounted respectively around the connecting columns on the cover.

15. The sprinkler assembly as claimed in claim 2, wherein the cover further has multiple connecting tubes formed on a bottom of the cover and connected respectively with the gear axles on the lower base; and multiple connecting columns formed on and protruding from the bottom of the cover; and the upper base further has multiple column holes defined in the top of the upper base and mounted respectively around the connecting columns on the cover.

* * * * *